US006871592B2

(12) United States Patent
Behrens et al.

(10) Patent No.: US 6,871,592 B2
(45) Date of Patent: Mar. 29, 2005

(54) METHOD FOR MOVING PRINTING PLATES INTO AND OUT OF EXPOSURE DEVICE

(75) Inventors: Gunnar Behrens, Kiel (DE); Bernd Lassen, Mönkeberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/373,890

(22) Filed: Feb. 25, 2003

(65) Prior Publication Data

US 2003/0188657 A1 Oct. 9, 2003

(30) Foreign Application Priority Data

Apr. 5, 2002 (DE) ..... 102 15 150

(51) Int. Cl.[7] ..... B65H 5/04; B41L 47/14

(52) U.S. Cl. ..... 101/477; 101/401.1; 347/262; 271/267; 355/132

(58) Field of Search ..... 101/477, 401.1; 347/262, 264; 355/100, 104, 99, 106, 132; 271/264, 267

(56) References Cited

U.S. PATENT DOCUMENTS 5,322,268 A * 6/1994 Okutsu et al. ..... 271/11
6,213,020 B1 4/2001 Kawada et al. ..... 101/486
6,260,482 B1 * 7/2001 Halup et al. ..... 101/477
2001/0052220 A1 12/2001 Usui et al. ..... 53/381.1

FOREIGN PATENT DOCUMENTS

| | | |
|---|---|---|
| DE | 32 07 903 A1 | 11/1983 |
| DE | 40 23 530 A1 | 1/1992 |
| DE | 42 05 595 A1 | 12/1992 |
| DE | 101 04 415 A1 | 8/2002 |
| DE | 101 34 151 A1 | 1/2003 |
| EP | 1 061 019 A2 | 12/2000 |
| EP | 1 130 471 A2 | 9/2001 |
| GB | 2 252 960 A | 8/1992 |

* cited by examiner

*Primary Examiner*—Leslie J. Evanisko
(74) *Attorney, Agent, or Firm*—Laurence A. Greenberg; Werner H. Stemer; Gregory L. Mayback

(57) ABSTRACT

A method, an apparatus, and a loader for moving (e.g., transporting) a printing plate into an exposer for printing plates and, after exposure, out of the exposer and into a processor, for example, saves space in the region of the exposer when moving the printing plate. In the method, the movement of the printing plate into the exposer takes place, at least in a path segment of the movement run, at a first level and the movement of the printing plate out of the exposer takes place, at least in a path segment of the movement run, at a second level that differs from the first level. The path segments of the movement run at the two different levels are each located on the same side of the exposer.

18 Claims, 3 Drawing Sheets

METHOD FOR MOVING PRINTING PLATES INTO AND OUT OF EXPOSURE DEVICE

BACKGROUND OF THE INVENTION

Field of the Invention

The invention relates to a method for moving, in particular, for transporting, a printing plate into an exposure device (recorder) for printing plates, and after exposure, out of the exposure device, and preferably into a development device (processor). The printing plate is, in particular, a daylight-sensitive undeveloped printing plate that is preferably from a supply unit (cassette) for printing plates.

The invention furthermore relates to an apparatus for moving, in particular, for transporting, a printing plate into an exposure device (recorder) for printing plates, and after exposure, out of the exposure device, and preferably into a development device (processor). Once again, the printing plate is, in particular, a daylight-sensitive undeveloped printing plate that is preferably from a supply unit (cassette) for printing plates. The apparatus enables the performance of the abovementioned method.

The invention also relates to a supply device (loader) for supplying a printing-plate exposer (recorder) with printing plates that will be exposed, and in particular for supplying printing plates using at least one cassette containing printing plates.

In the production of print-ready printing plates for offset printing, unexposed printing plates are successively fed into a printing-plate exposure device, referred to simply as an exposer or recorder, and are exposed there. That is to say, printing-image information is recorded on the printing plate in the exposer, and the exposed printing plates are discharged. This may take place thermally, for example, using higher-energy laser beams so that the printing plates are daylight-insensitive. Alternatively, the recording can take place, for example, using low-energy laser beams, in a similar way to an exposure of a photosensitive film such that the printing plate is then daylight-sensitive, and after exposure, has to be developed and fixed in a development device, referred to simply as a processor, before it can be exposed to daylight and used for printing.

The sequence of movement of the printing plate into the exposer and out of the exposer is preferably automated. For automatically supplying the exposer with printing plates that will be exposed, a supply device, referred to simply as a loader or autoloader, is docked on an entry side of the exposer. For transferring printing plates out of the loader into the exposer, the loader can also be connected to the exposer, for example, by using a tunnel-like bridge.

In this case, such a loader can store and provide printing plates in one or more cassettes. For transferring the printing plates to the exposer, a cassette can be slightly introduced into the exposer or into the bridge, and the printing plates can then be dispensed individually out of the cassette into the exposer. Storing a plurality of cassettes in the loader has the advantage that, for example, printing plates of different formats can be kept ready and discharged quickly, so that format changes can be accomplished rapidly. At the same time, a cassette does not have to be emptied in each case, but, for example, after the extraction of some printing plates, can be closed again by a cover.

After exposure, a daylight-sensitive printing plate is discharged from the exposer and is transferred into a processor, and this, in turn, may take place, for example, via a tunnel-like bridge on the side of the exposer that faces away from the loader. The loader, exposer, and processor are in this case therefore arranged one behind the other in a row or a processing chain. Such an arrangement is known, for example, from published European Patent Application EP 1 061 019 A. This shows what is known as an outer drum exposer, in which the printing plate is tension-mounted, for exposure, on the outside of a drum. Alternatively, for example, what is known as an inner drum exposer may also be used, in which the printing plate is placed, for exposure, in a semicylindrical trough, such as proposed, for example, in published German Patent Application DE 101 04 415.1.

The known arrangement of the loader, exposer and processor one behind the other requires a relatively large space in terms of standing area. This is known as the footprint, since, in particular, the tunnel-like bridge connection between the exposer and the processor requires a certain amount of length, in order to, despite the connection, sufficiently uncouple the working sequences of the two apparatuses from one another.

SUMMARY OF THE INVENTION

It is accordingly an object of the invention to provide a method for moving a printing plate in the region of an exposer which overcomes the above-mentioned disadvantages of the prior art methods of this general type, and which in particular, enables movement, in particular, transportation of the printing plate in a space-saving and preferably also a time-saving way.

It is also an object of the invention to provide an apparatus and/or a supply device of the respective generic type initially mentioned that enables movement, in particular, transportation of the printing-plate in the region of the exposer in a space-saving and time-saving way.

With the foregoing and other objects in view there is provided, in accordance with the invention, a method for moving a printing plate into and out of an exposure device. The method includes steps of: at least in a first segment of a movement run, moving the printing plate at a first level into a side of the exposure device; and after the printing plate is exposed, at least in a second segment of the movement run, moving the printing-plate at a second level out of the side of the exposure device.

In accordance with an added feature of the invention, the printing plate is an undeveloped daylight-sensitive printing plate.

In accordance with an additional feature of the invention, when performing the step of moving the printing plate into the exposure device, the printing plate is obtained from a supply unit for printing plates.

In accordance with another feature of the invention, when performing the step of moving the printing plate out of the exposure device, the printing plate is moved into a development device.

In accordance with a further feature of the invention, the second level is higher than the first level.

In accordance with a further added feature of the invention, the first segment and the second segment each extend within a supply device for printing plates.

In accordance with a further additional feature of the invention, when performing the step of moving the printing plate at the second level, the printing plate is moved at least partially transversely to a movement taking place when performing the step of moving the printing plate at the first level.

In accordance with another added feature of the invention, the movement run is at least approximately L-shaped, as seen in a top view.

In accordance with another additional feature of the invention, a conveyor is provided at the second level for conveying the printing plate.

In accordance with yet an added feature of the invention, a switch is provided for selectively connecting the exposure device to the first level and the second level.

In accordance with yet an additional feature of the invention, the switch is designed as a pivoting table pivotable about a horizontal axis.

In accordance with yet another feature of the invention, at least one lock for sealing out light is configured in a transitional region between a supply device for printing plates and the exposure device.

In accordance with yet a further feature of the invention, the lock has closing flaps.

In accordance with an added feature of the invention, the closing flaps are actuated with a cassette for printing plates.

In accordance with an additional feature of the invention, the closing flaps are opened by pushing a cassette for printing plates into the lock.

In accordance with a further feature of the invention, rolling elements are provided on sides of the closing flaps facing the cassette.

In accordance with a further added feature of the invention, the closing flaps cooperate with a cassette closure.

In accordance with a further additional feature of the invention, the cassette closure has a blind-like design and is openable and closable by a displacement parallel to a traveling movement of the cassette.

In accordance with another further feature of the invention, the method includes configuring at least one lock for sealing out light in a transitional region between a supply device for printing plates and the exposure device; providing the lock with closing flaps; opening the closing flaps by pushing a cassette for printing plates into the lock; and providing the lock with at least one sealing element for sealing off a clear interspace remaining between the cassette and the lock.

In accordance with a further feature of the invention, the sealing element has a brush-like design.

In terms of the generic method, the movement of the printing plate into the exposure device takes place, at least in a path segment or portion of the movement run, at a first level. The movement of the printing plate out of the exposure device takes place, at least in a path segment or portion of the movement run, at a second level that differs from the first level. The path segments or portions of the movement run at the two different levels are located on the same side of the exposure device.

The advantageous at least partial arrangement of path segments or portions of the movement travel of a printing plate one above the other, results in a kind of folding of this movement travel in the third space dimension, thus leading directly to a desired space saving in the two horizontal dimensions of the standing area of the apparatuses involved.

Preferably, the first level is lower than the second level, so that, advantageously, heavy cassettes only need to be brought to the lower level and handled there, and only the individually separated printing plates, after their exposure, have to be brought to the next higher level, which can be accomplished without difficulty.

The path segments having the different levels are preferably accommodated completely or partially in a loader, so that the existing standing area of the loader can also perform the function of a next connecting bridge, without requiring further standing area for this purpose. However, even without a loader, when an exposer is supplied manually, the inventive design of the movement travel of the printing plates is advantageous.

The direction of movement takes place, at the second level, preferably at least partially transversely to the first direction of movement, so that it is possible to have a compact arrangement of the loader, exposer and processor in an L-shape, in which, advantageously, the processor is connected directly to the loader, instead of to the exposer. In this case, it is necessary to allow for the fact that corresponding additional free spaces have to be provided for supply to and disposal from the apparatuses involved, which, in the case of the L-shape mentioned, is possible by using a simple, relatively square and space-saving three-dimensional blank.

The set object is achieved independently by a generic apparatus that is distinguished in that the movement travel of the printing plate into the exposure device runs, at least in the region of a path segment, at a first level, and in that the movement travel of the printing plate out of the exposure device runs, at least in the region of a path segment, at a second level which differs from the first level. The path segments of the movement travel at the two different levels are located on the same side of the exposure device.

The advantages arising from this configuration have already been explained with regard to the method.

In another development of the apparatus, the two levels are equipped with conveyors for the printing plates. In this case, the conveyors are preferably in each case designed to be of a size such that they can receive the printing plates completely and quickly, in order thereby to be capable of working in a time-saving manner with the apparatuses.

To achieve the two levels, a kind of switch is preferably provided, which is preferably designed as a pivoting table that is pivotable about a horizontal axis and that is preferably an integral part of the exposer.

In yet another development of the invention, at least one lock for sealing out light is provided in the transitional region between a supply device (loader) for printing plates and the exposure device. This makes it easier to change a cassette at any time.

The lock preferably has closing flaps that can be actuated preferably by a cassette for printing plates. In particular, the closing flaps can be opened by pushing a cassette into the lock. In this case, preferably, guiding and friction-reducing rolling elements are provided on the closing flaps.

A particularly advantageous development of the invention provides for the closing flaps to cooperate with a cassette closure. The cassette, too, is therefore positively closed in a light-tight manner at any time outside the lock. The closing flaps or else a single closing flap of the lock is opened as a lock gate by the cassette itself, and therefore an additional handle or the like may be dispensed with. On the other hand, the lock gate automatically opens and/or closes the cassette closure in a purely mechanical way. This is particularly important, should a cassette-closing actuation device be defective or an energy supply be interrupted.

For this purpose, in a development of the cassette, the cassette closure has a blind-like or shutter-like design and can be opened and closed by a displacement parallel to the movement travel of the cassette.

Any light interspaces still remaining between the cassette and the lock are preferably additionally closed by one or more sealing elements that are designed, for example, as rubber-like sealing lips, but preferably as brushes.

A supply device (loader) is provided for supplying a printing-plate exposer (recorder) with printing plates to be exposed, in particular for providing printing plates using at least one cassette containing printing plates. The supply device is distinguished in that the movement travel of the printing plate into the exposure device runs, at least in the region of a path segment, at a first level, and in that the movement travel of the printing plate out of the exposure device runs, at least in the region of a path segment, at a second level which differs from the first level. The path segments of the movement travel at the two different levels are located on the same side of the exposure device. The path segments of the movement travel at the two different levels are each located within the supply device for printing plates.

In this case, a path segment preferably at the second level runs, at least partially, transversely to a path segment at the first level, within the supply device.

Other features which are considered as characteristic for the invention are set forth in the appended claims.

Although the invention is illustrated and described herein as embodied in a method, apparatus and supply device for moving printing plates, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
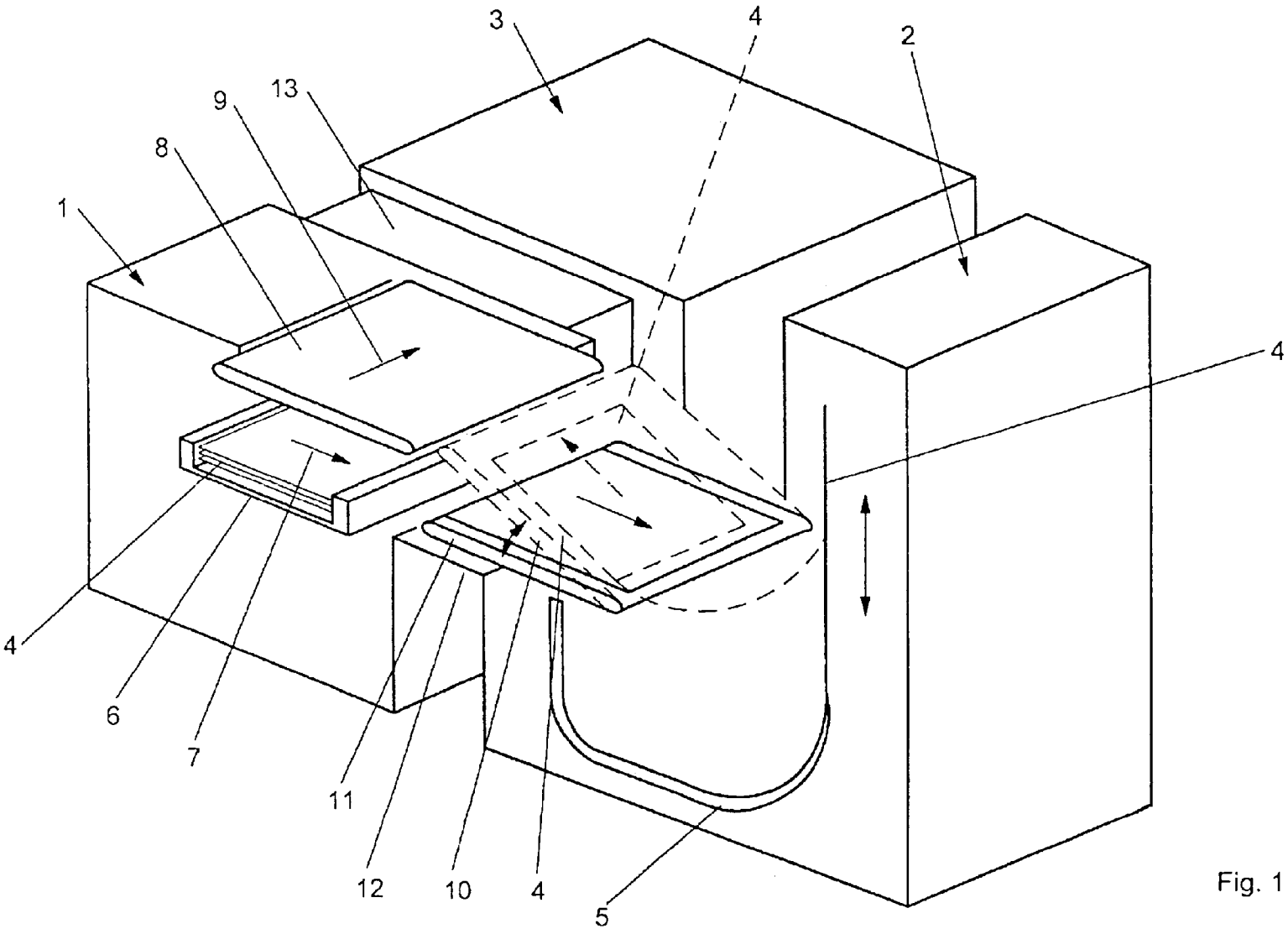
FIG. 1 is a perspective view of an inventive configuration of a loader, an exposer, and a processor.

Referring now to the figures of the drawing in detail and first, particularly, to FIG. 1 thereof, there is shown a diagrammatic perspective view of a configuration of a loader 1, an exposer 2, and a processor 3 that are connected to one another in an L-shape in an inventive way.

An inner drum exposer, such as that disclosed in published German Patent Application DE 101 04 415.1 that has already been mentioned, is used as the exposer 2. In this exposer 2, a printing plate 4 that will be exposed is introduced into a trough 5 from above.

In the loader 1, a cassette 6 with further printing plates 4 is shown at a first lower level, from which printing plates can be fed into the exposer 2 in the direction of an arrow 7 in a way not illustrated in any more detail. A suitable printing-plate transfer from a loader 1 into an exposer 2 has already been disclosed, for example, in published German Patent Application DE 101 34 151.2.

Above the cassette 6, is a conveyor 8 that is located at the second level in the loader 1. The conveyor 8 transfers printing plates 4 coming from the exposer 2 into the processor 3 in the direction of the arrow 9, which is in a direction transverse to the arrow 7.

To selectively reach the first or second level, a pivoting table 11 pivotable about a horizontal axis 10 is provided as a kind of switch in the region of the exposer 2. Tunnel-like connecting bridges 12, 13 are also shown in FIG. 1.

Figure 2:
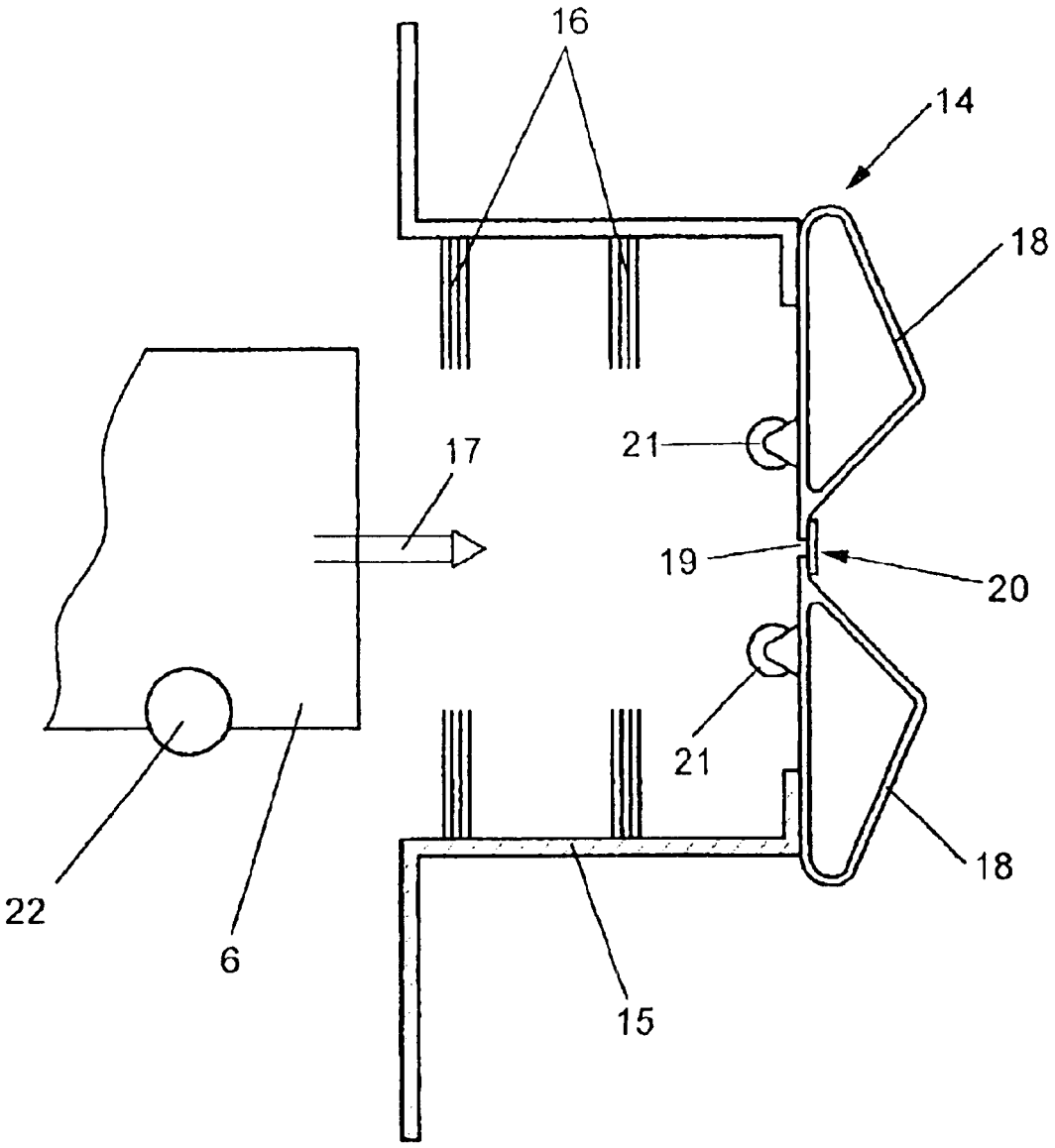
FIG. 2 is a cross sectional view of a light-tight lock, which is in the closed state, for the exposer shown in FIG. 1.
Figure 3:
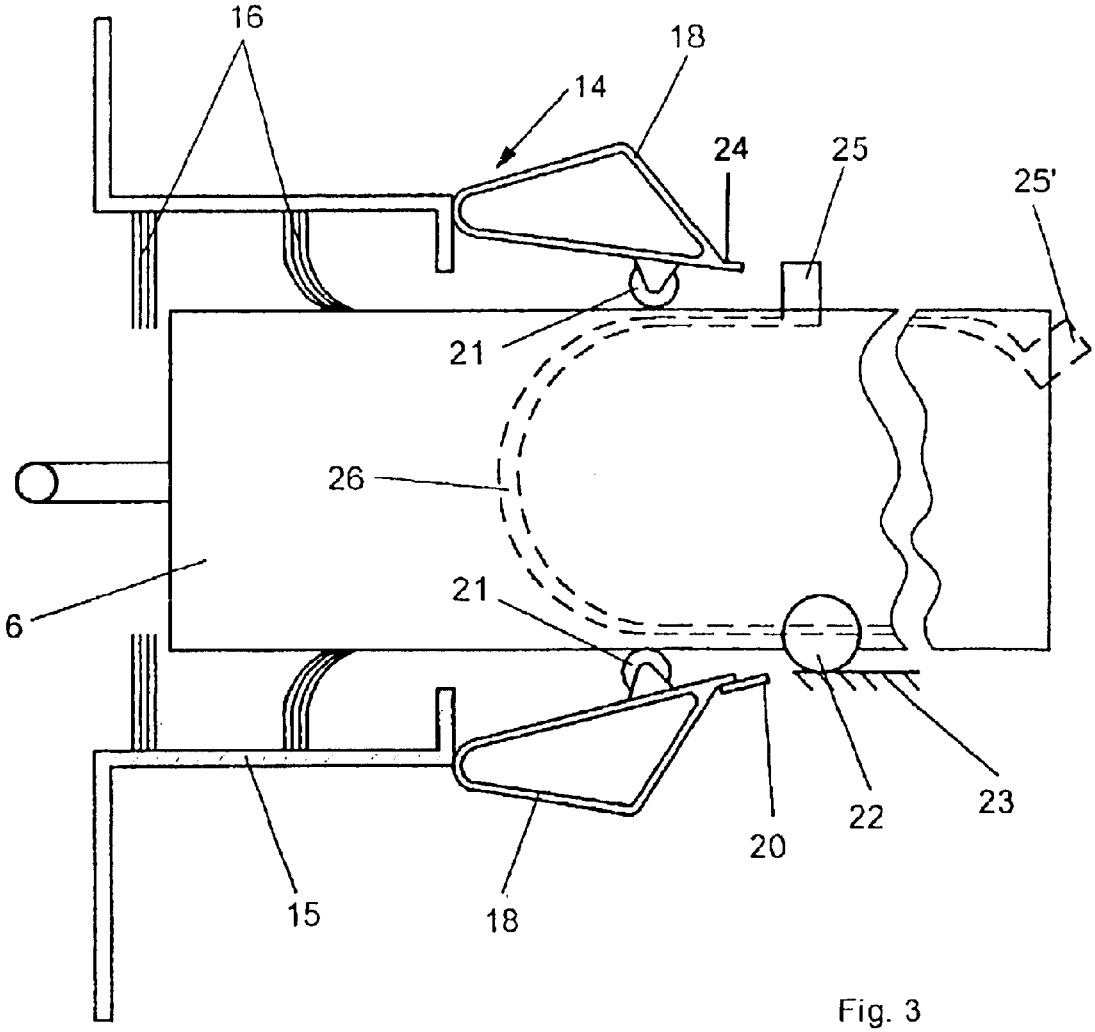
FIG. 3 is a cross sectional view of the lock shown in FIG. 2, which is in the open state, and which has a cassette for printing plates introduced therein.

FIGS. 2 and 3 show cross sectional views of a light-tight lock 14 that may be provided in the region of the connecting bridge 12. FIG. 2 shows the light-tight lock 14 in the closed state and FIG. 3 shows the light-tight lock 14 in the open state.

The lock has a wall 15 that is of tunnel-like shape and from which peripheral brushes 16 project inward as sealing elements. As indicated, a cassette 6 can be pushed from one side of the lock 14 into the lock in the direction of the arrow 17. On the other side, the lock has closing flaps 18 which open by the cassette 6 that is being pushed in. A gap 19 remaining between the closed closing flaps 18 is closed by a cover strip 20.

During the opening of the closing flaps 18, rolling elements 21 roll on the cassette wall as shown in FIG. 3. Moreover, wheels 22 of the cassette 6 roll on a cassette guide 23 not illustrated in any more detail (See FIG. 3).

Moreover, when the cassette 6 is being drawn out of the lock 14 opposite to the direction of the arrow 17, one edge 24 of a closing flap 18 cooperates with an upwardly projecting stop strip 25 of a blind-like cassette closure 26 and positively closes the latter due to displacement or retention when the cassette 6 is being drawn out, until the stop strip 25 is located in the end position 25', indicated by broken lines, on that end face of the cassette 6 which faces the exposer.

We claim:

1. A method for moving a printing plate into and out of an exposure device, which comprises:

at least in a first segment of a movement run, moving the printing plate at a first level into a side of the exposure device;

providing a switch for selectively connecting the exposure device to the first level and to a second level; and after the printing plate is exposed, at least in a second segment of the movement run, moving the printing plate at the second level out of the side of the exposure device.

2. The method according to claim 1, which comprises providing the printing plate as an undeveloped daylight-sensitive printing plate.

3. The method according to claim 1, which comprises, when performing the step of moving the printing plate into the exposure device, obtaining the printing plate from a supply unit for printing plates.

4. The method according to claim 1, which comprises, when performing the step of moving the printing plate out of the exposure device, moving the printing plate into a development device.

5. The method according to claim 1, wherein the second level is higher than the first level.

6. The method according to claim 1, wherein the first segment and the second segment each extend within a supply device for printing plates.

7. The method according to claim 1, wherein when performing the step of moving the printing plate at the second level, the printing plate is moved at least partially transversely to a movement taking place when performing the step of moving the printing plate at the first level.

8. The method according to claim 1, wherein the movement run is at least approximately L-shaped, as seen in a top view.

9. The method according to claim 1, which comprises providing a conveyor at the second level for conveying the printing plate.

10. The method according to claim 1, which comprises designing the switch as a pivoting table pivotable about a horizontal axis.

11. The method according to claim 1, which comprises configuring at least one lock for sealing out light in a transitional region between a supply device for printing plates and the exposure device.

12. The method according to claim 11, which comprises providing the lock with closing flaps.

13. The method according to claim 12, which comprises actuating the closing flaps with a cassette for printing plates.

14. The method according to claim 12, which comprises opening the closing flaps by pushing a cassette for printing plates into the lock.

15. The method according to claim 14, which comprises providing rolling elements on sides of the closing flaps facing the cassette.

16. The method according to claim 14, wherein the closing flaps cooperate with a cassette closure.

17. The method according to claim 16, which comprises providing the cassette closure with a blind-like design openable and closable by a displacement parallel to a traveling movement of the cassette.

18. A method for moving a printing plate into and out of an exposure device, the method which comprises:

at least in a first segment of a movement run, moving the printing plate at a first level into a side of the exposure device;

after the printing plate is exposed, at least in a second segment of the movement run, moving the printing plate at a second level out of the side of the exposure device;

configuring at least one lock for sealing out light in a transitional region between a supply device for printing plates and the exposure device;

providing the lock with closing flaps;

opening the closing flaps by pushing a cassette for printing plates into the lock;

providing the lock with at least one sealing element for sealing off a clear interspace remaining between the cassette and the lock; and providing the sealing element with a brush-like design.

* * * * *